United States Patent [19]

Jasinski et al.

[11] Patent Number: 4,679,489

[45] Date of Patent: Jul. 14, 1987

[54] AUTOMATIC LEVELING SYSTEM FOR BLAST HOLE DRILLS AND THE LIKE

[75] Inventors: Richard A. Jasinski, Oak Creek; Donald M. Mains, Greendale, both of Wis.

[73] Assignee: Becor Western Inc., South Milwaukee, Wis.

[21] Appl. No.: 794,778

[22] Filed: Nov. 4, 1985

[51] Int. Cl.[4] ..... F15B 21/02; F15B 11/22

[52] U.S. Cl. ..... 91/36; 91/171; 91/361; 280/6 R

[58] Field of Search ..... 91/36, 171, 361, 459; 280/6 R, 6 H, 707; 187/17, 28

[56] References Cited

U.S. PATENT DOCUMENTS

| | | | |
|---|---|---|---|
| 3,241,458 | 3/1966 | Goldie | 91/171 |
| 3,377,924 | 4/1968 | Spencer et al. | 91/171 |
| 3,606,247 | 9/1971 | Liston | 254/86 H |
| 3,625,483 | 12/1971 | Stoner | 254/86 H |
| 3,627,268 | 12/1971 | Wills | 254/86 H |
| 3,638,535 | 2/1972 | Ponter | 91/171 |
| 3,703,298 | 11/1972 | Lauerda | 280/6 H |
| 4,050,704 | 9/1977 | Duca et al. | 280/6 R |
| 4,142,710 | 3/1979 | Ukuda | 254/86 H |
| 4,165,861 | 8/1979 | Hanser | 254/86 H |
| 4,247,126 | 1/1981 | Claxton | 280/6 H |
| 4,390,187 | 6/1983 | Maeda | 280/6 R |
| 4,420,167 | 12/1983 | Winblad | 280/6 H |
| 4,453,725 | 6/1984 | Kuwana et al. | 280/6 R |
| 4,483,546 | 11/1984 | Brearley | 280/6 R |

FOREIGN PATENT DOCUMENTS 149561 7/1981 German Democratic Rep. ... 91/171

*Primary Examiner*—Robert E. Garrett
*Assistant Examiner*—Mark A. Williamson
*Attorney, Agent, or Firm*—Quarles & Brady

[57] ABSTRACT

A dual automatic leveling system for a blast hole drill during raising and lowering which includes "fine" level sensors to detect an attitude within a fine level range and "coarse" level sensors to detect an attitude outside a coarse level range which is greater than that of the first. A controller is connected to the sensors as well as to appropriate valving with a pressurized fluid source so as to operate hydraulic jacks. The jacks are activated in a first mode in conjunction with the "fine" sensors and in a second mode in conjunction with the "coarse" sensors. In a preferred manner, the "fine" and "coarse" level sensors are positioned as front, rear, and end level sensors mounted on the main frame of the blast hole drill. The "fine" level sensors in conjunction with a programmable logic control will initially level the drilling platform within a ±0.5° (both transverse and longitudinally). If during the raising or lowering process the platform becomes out of level by 2° or more, the "coarse" level sensors in conjunction with the programmable logic control will cause the raising or lowering process to stop and a re-leveling to ±0.5° is effected before a raising or lowering is continued.

13 Claims, 13 Drawing Figures

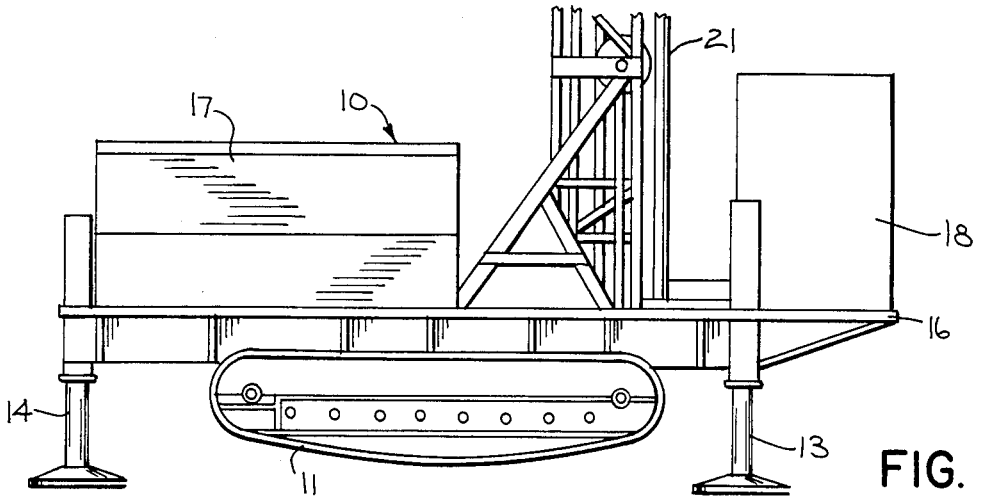
FIG. 1
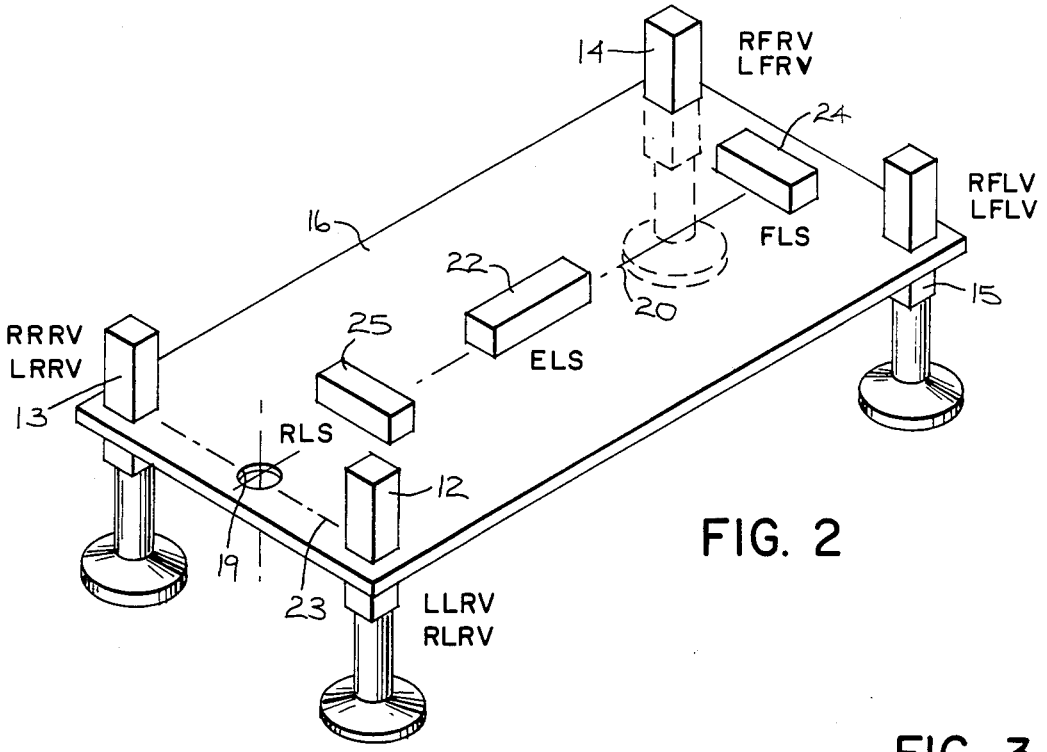
FIG. 2
FIG. 3
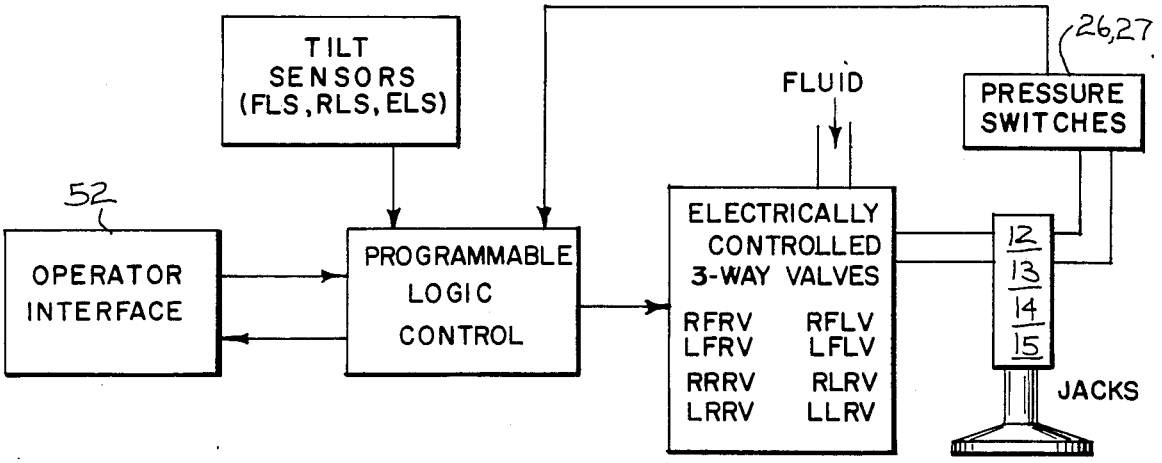

FIG. 9d

| SYMBOL | DESCRIPTION |
|---|---|
| CLS | Course Machine Level Switch |
| DRM | Drill Mode |
| ELS | End Level Sensor |
| ELS1 | End Level Sensor |
| ELS2 | End Level Sensor |
| FLR | Fine Level Relay |
| FLS | Front Level Sensor |
| FLS1 | Front Level Sensor |
| FLS2 | Front Level Sensor |
| FRPS | Full Retract Pressure Switch |
| FSAR | Fine Sensor Active Relay |
| GPR | Ground Pressure Relay |
| GPS | Ground Pressure Switch |
| JFLS | Jacks Front Left Switch |
| JFRR | Jacks Full Retract Relay |
| JFRS | Jacks Front Right Switch |
| JIR | Jack Interposing Relay |
| JLV | Jack Loader Valve |
| JMS | Jacks Control Select Switch |
| JMSL | Jack Mode Select Lower |
| JMSR | Jack Mode Select Raise |
| JRLS | Jacks Rear Left Switch |
| JRRS | Jacks Rear Right Switch |

FIG. 9e

| SYMBOL | DESCRIPTION |
|---|---|
| LFLV | Lower Front Left Valve |
| LFRV | Lower Front Right Valve |
| LLR | Longitudinal Level Relay |
| LLRV | Lower Rear left Valve |
| LRRV | Lower Rear Right Valve |
| MLL | Machine Level Lamp |
| MLLA | Machine Level Relay |
| MLR | Machine Lower Relay |
| MRR | Machine Raise Relay |
| MTR | Machine Tilt Relay |
| PG | Pulse Generator |
| PPR | Pilot Pressure Relay |
| RFLV | Raise Front Left Valve |
| RFRV | Raise Front Right Valve |
| RLRV | Raise Rear Left Valve |
| RLS | Rear Level Sensor |
| RLS1 | Rear Level Sensor |
| RLS2 | Rear Level Sensor |
| RRRV | Raise Rear Right Valve |
| SSLR | Side to Side Level Relay |
| TRLR | Transverse Level Relay |
| CV6, LL1, LL2, LD2 & PC5 | Electrical Line Connections |

AUTOMATIC LEVELING SYSTEM FOR BLAST HOLE DRILLS AND THE LIKE

BACKGROUND OF THE INVENTION

Blast hole drills are large but mobile machines used primarily in surface mining to drill holes for explosives. They are mounted on crawlers to provide mobility but are provided with hydraulic jacks to raise and support the machine off the crawlers during drilling operations. It is important that the machine be level for drilling to assure that the drill hole will be at the desired angle or vertical. It is also important that the raising or lowering procedure be conducted with the platform as level as possible so as to reduce frame stress. Further, the time required to perform a raising or lowering procedure should be maintained at a minimum.

Various types of raising and leveling systems for blast hole drills have been provided in the past. In some instances the entire leveling operation was controlled manually. One type of automatic leveling system for blast hole drills is described in U.S. Pat. No. 3,625,483 which is assigned to the assignee of this invention. In that particular leveling system, proportioning valves were utilized in conjunction with two level sensors for monitoring the raising and lowering of the main frame of a blast hole drill. In U.S. Pat. No. 4,453,725 a road vehicle level controller is described wherein a microcomputer is used in conjunction with a five level detector operation.

The prior art does not provide an automatic leveling system for large and heavy industrial equipment wherein the raising or lowering procedure can be stopped when the deck of the equipment is out of level by more than a predetermined degree and which can re-level the deck within a prescribed degree. The prior art is mainly concerned with continuous type leveling systems for blast hole drills or with maintaining vehicles at predetermined levels based upon weight loads.

It is an advantage of the present invention to provide an automatic leveling system for blast hole drills or the like which can automatically monitor the machine within a predetermined degree of level during raising or lowering.

It is another advantage of this invention to provide leveling system of the foregoing type which is especially suitable for being controlled by a programmable controller.

It is yet another object of this invention to provide an automatic leveling system for a blast hole drill which reduces main frame stress during raising or lowering, increases hole pattern accuracy and reduces the amount of operator interface. Other features and advantages of the invention will become apparent as well as a better understanding of the invention from the descriptions following.

SUMMARY OF THE INVENTION

The present invention contemplates a leveling system for a blast hole drill which has a base plane. Jack means are spaced from one another and define a first and second axis in the base plane which are generally transverse to each other. Fluid supply means are operatively connected to the jack means and valve means are connected to the fluid supply means and to the jack means. Sensor means are adapted to continuously detect the attitude of the base plane divided along the first and second axes. The sensor means includes a first sensor device to detect an attitude within a fine level range and a second sensor device to detect an attitude ouside a coarse level range. Control means are operatively connected to the sensor means and the valve means to provide a first mode of operation of the jack means and a leveling of the base plane in conjunction with the first sensor device followed by a raising or lowering of the base plane. A second mode of operation of the jack means and a releveling of the base plane is effected in conjunction with the second sensor device. In a preferred manner, the base plane is defined by a deck and the jack means are provided by two pairs of hydraulic jacks positioned adjacent to corners of the base deck. Also preferably, the jack means include ground pressure switches and full retract pressure sense switches. The sensor means are constructed and arranged to detect the attitude of the base plane along the first and second axis and at three different locations. Also preferably, the first sensor device is referred to as a "fine sensor" and is adapted to detect a level condition within a fine level range of $\pm 0.5°$ and the second sensor device is referred to as a "coarse sensor" and is adapted to detect an out of level condition outside a coarse level range of about 2°. In one embodiment, the control means includes a programmable logic control.

BRIEF DESCRIPTION OF THE DRAWINGS

FIG. 1 is a partial side view of a blast hole drill incorporating the automatic leveling system of this invention.

FIG. 2 is a schematic view in perspective illustrating the frame or base plane of the machine of FIG. 1, the supporting jacks, and the reference axes to be referred to in the specification as well as the positioning of the various level sensor devices.

FIG. 3 is a schematic view illustrating the interaction of the various components utilized in raising and lowering the hydraulic jacks as well as the blast hole drill platform.

Figure 5:
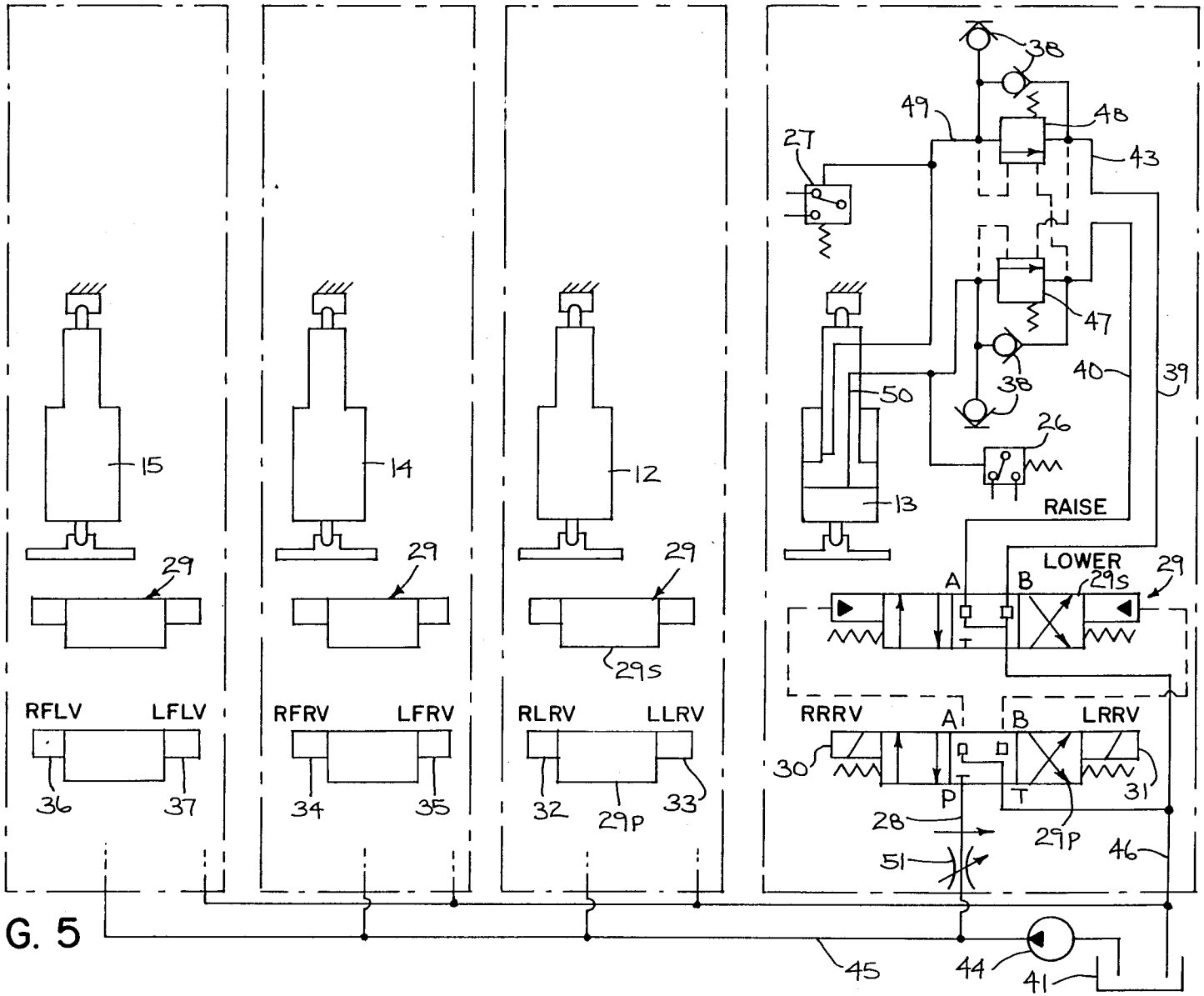
FIG. 5 is a hydraulic schematic view showing the interrelationship of the jacks and the activating valves.

FIGS. *9a–9e* represent schematic views of the programmable computer as well as the symbol descriptions utilized therewith.

DESCRIPTION OF THE PREFERRED EMBODIMENTS

The blast hole drill shown in FIG. 1 is designated generally by the reference numeral 10 and will include the usual crawler vehicle 11 by means by which it may be moved from location to location. It is supported in a working position and raised and lowered to this position by four double acting hydraulic jacks, comprising rear jacks 12 and 13 (See FIG. 2) and two front jacks 14 and 15. It should be noted with respect to FIGS. 1 and 2, the blast hole drill has been reversed in position. The jacks 12–15 are mounted on a main frame 16 which is supported on the crawler 11 and serves as a platform or a deck for the drill mast 21 and the operating machinery 17 as well as an operator's cab 18. The frame 16 serves to define a base plane for the machine 10 which must be level in order for the machine as a whole to be level.

As can be seen in FIG. 2, the left and right rear jacks 12 and 13, respectively, are positioned adjacent corners of the deck with the drilling guide hole 19 positioned therebetween. At the opposite end are similarly situated right front jack 14 and the left front jack 15. Each one of the jacks 12–15 will have a raising and a lowering valve which are designated adjacent each jack. For example, RFRV indicates a Raising of the Front Right Valve and LFRV indicates a Lowering of the Front Right Valve. These will be later explained in conjunction with FIG. 5. Positioned along a longitudinal axis 20 is a tilt sensor such as an end level sensor (ELS) 22. Positioned adjacent the front and rear of the main frame 16 and orientated with the transverse axis 23 are additional tilt sensors such as a front level sensor (FLS) 24 and a rear level sensor (RLS) 25.

Figure 4:
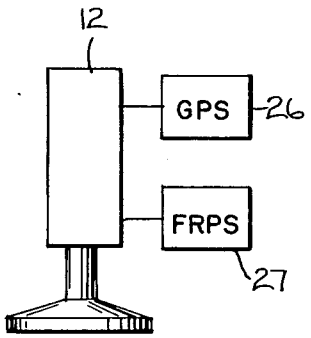
FIG. 4 is a schematic view of a representative hydraulic jack.
Figure 6:
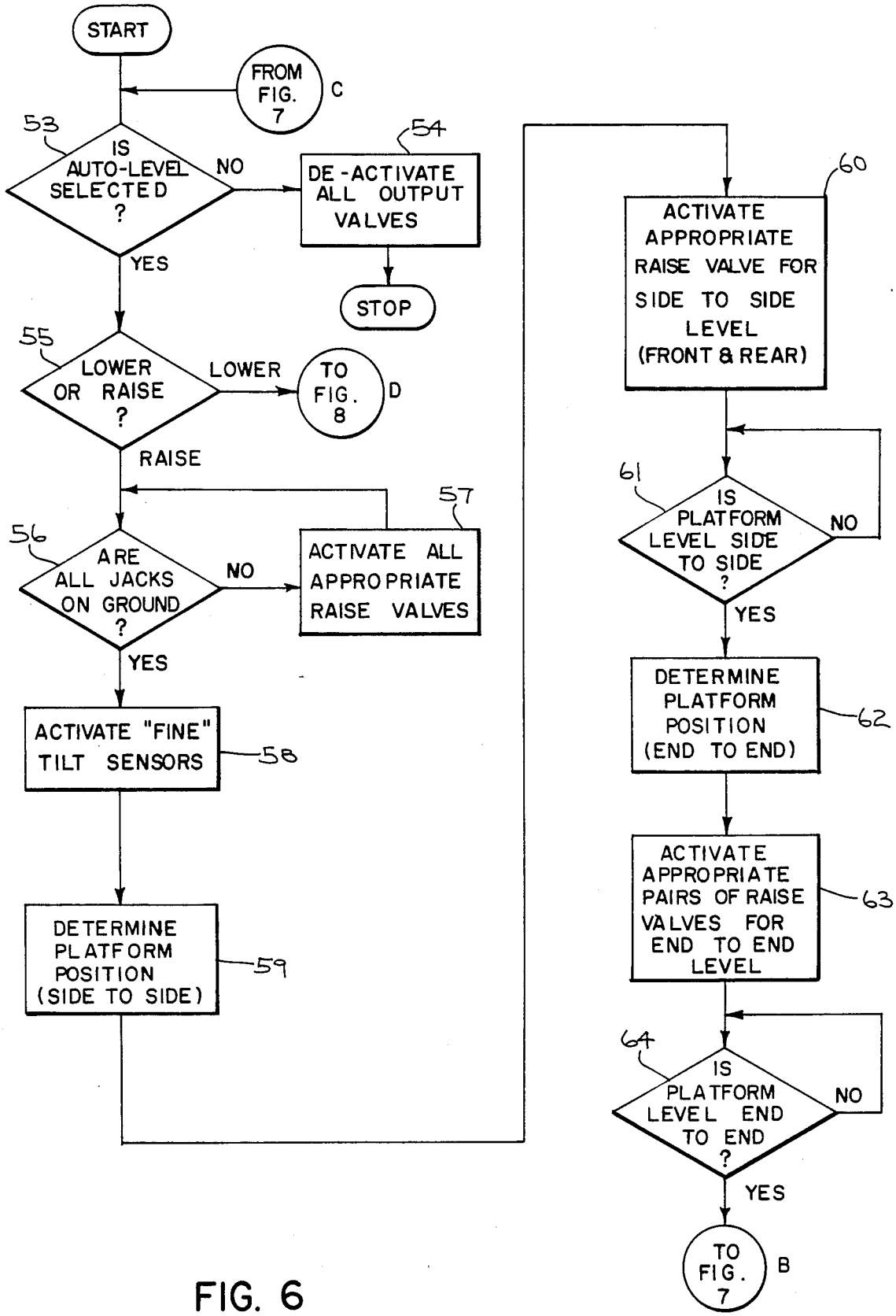
FIGS. 6–8 are flow charts illustrating a sequence of control operations performed by the programmable controller as it operates in conjunction with the ladder diagram logic described herein.
Figure 7:
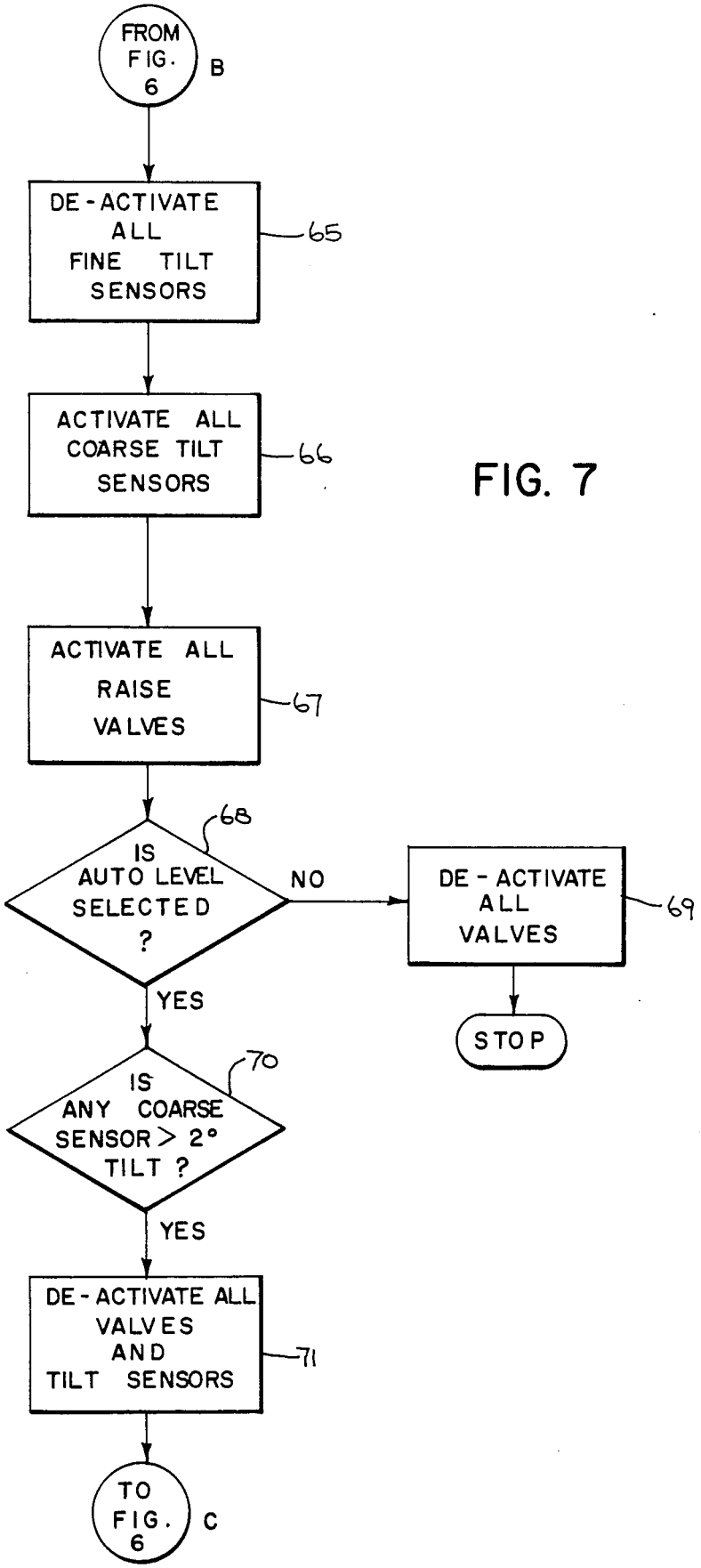

Referring to FIG. 4, a hydraulic jack such as 12 is of the standard type and will have connected thereto a ground pressure switch (GPS) 26 and a full retract pressure switch (FRPS) 27. The purpose of the switches will be further explained in conjunction with the control operations referred to in FIGS. 6–8.

In FIG. 3, the interrelationship of the various major components of the leveling system of this invention is indicated. A signal from the tilt sensors such as the front level sensor, the rear level sensor and the end level sensor are fed to a programmable logic control. The particular programmable logic control is one supplied by the Allen Bradley Company as PLC-2/15.0. This programmable logic control will act upon signals supplied by the tilt sensors 22, 24, and 25 as well as the ground pressure switch 26 and the full retract pressure switch 27. This data will then be utilized in conjunction with the program supplied by the programmable logic control to activate or deactivate the three way electric raising and lowering valves connected with the jacks 12–15. It should be pointed out that the front level sensor 24, the rear level sensor 25 and the end level sensor 22 all include right and left fine sensors ($S_1$) and ($S_2$) for sensing a level condition within $\pm 0.5°$ as well as right and left coarse sensors ($C_1$) and ($C_2$) for sensing an out of level condition greater than 2°. For example, the front and rear level sensors will have fine sensors for sensing a right and left tilting of the main frame 16 as well as a right and left coarse sensor for sensing a greater degree of tilting of the main frame 16. With respect to the end level sensor, the fine and coarse sensors will sense end to end fine and coarse level conditions. These fine and coarse sensors will be of the mercury switch type.

Referring to FIG. 5, the interrelationship of the raising and lowering valves is depicted in conjunction with the raising and lowering jacks 12–15. Each jack is controlled by a three position spring centered, double solenoid, four ported valve designated generally 29. There are four such valves employed for the four jacks and each valve 29 will have a pilot portion designated 29P and a slave portion designated 29S. The reference numeral 30 will represent the Raise Right Rear Valve portion and numeral 31 the Lower Right Rear Valve portion. Similarly, 32 is the Raise Left Rear Valve portion and 33 is the Lower Left Rear Valve portion. Reference numeral 34 is the Raise Front Right Valve; 35 the Lower Front Right Valve; 36 is the Raise Front Left Valve and 37 the Lower Front Left Valve portion. The valves 29 are connected to a pump line 45 which in turn is connected to the pump 44. The source of oil for the pump 44 is the reservoir 41. It will be seen that the pump line 45 is interconnected to the valve ports with a raise line 40 interconnected to the A port and a lower line 39 connected to the B port. A return line 46 is interconnected to the port designated as T and the pump input line 28 is connected to the port designated as P. The raise and lower lines 40 and 39 are in turn connected to double counter balance valve 43 for purposes of extending or retracting the hydraulic jacks such as 13. As indicated earlier, interconnected with each jack is a ground pressure switch 26 and a full retract pressure switch 27. As indicated schematically, the raise line 40 is interconnected to the jack 13 and through the valve 47 to cause an extension of the jack and accordingly a raising of the machine. Conversely, lowering line 39 is interconnected through the valve 48 so as to cause a retraction of the jack through the interconnection with the line 49. The line 50 serves a similar purpose in extending the jack 13. Disconnect valves 38 are also employed if desired. It should be noted that in conjunction with the input line 28 to the valves 29 a pressure compensated flow control 51 is provided for each of the valves 29 so that the extension or retraction of the jacks 12–15 will be in a uniform manner.

Referring to FIGS. 6–10, the control operations by the programmable logic control will now be described with reference being made to the ladder logic control indicated in the Appendix A. The computer will be controlled by an operator's interface 52. (See FIG. 3) to determine whether the automatic leveling system is selected or not. This is indicated by decision block 53. If it is, the machine raise or machine lower relay designated MRR or MLR in the Appendix A must be true. If a deactivated function is selected all of the output valves designated by the numerals 30–37 will be turned off as indicated by process block 54. If an automatic leveling mode is selected then the decision is made whether to lower or raise the machine as represented by decision block 55. If the lowering mode is selected then that portion indicated by the letter D in the flow diagram will be instituted as will be later explained. If the raise mode is selected then the computer determines as indicated by process block 56 if all the jacks are on the ground through the sensing of the ground pressure switches 26. If not, then all of the raise valves 30, 32, 34 and 36 are activated to cause an extension of the jacks 12–15 as represented by process block 57. If all the jacks are on the ground, then the programmable logic control (PLC) will activate the fine tilt sensors S-1 and S-2 as shown by process block 58. The PLC will check the state of the fine tilt sensors S-1 and S-2 for the front level sensor 24, the rear level sensor 25 and the end level sensor 22. The PLC will look at the fine sensors S-1 and S-2 of the front and rear level sensors to determine how much the machine is tilted side-to-side as represented by decision block 59. When the position is determined the appropriate valves 30, 32, 34 and 36 are turned on to raise the machine to a level state as indicated by process block 60. The next determination as seen at decision block 61, is whether the platform or base deck 16 is level from side to side. If a "no" condition, the preceding step is repeated. If a "yes" condition, the computer will look at S-1 and S-2 of the end level sensor 22 to determine the machine tilt end-to-end as indicated by decision block 62. The appropriate pairs of raise valves 30, 32, 34 and 36 will be activated in the front or back to raise the machine to a level state as represented by process block 63. Again, a wait or decision point as indicated by decision block 64 is reached to determine if a level condition end-to-end is made. If a "no" condition, the process is repeated. If a "yes" condition that stage which is marked in the flow chart as B and process block 65 is next pursued and all of the fine tilt sensors S-1 and S-2 will be deactivated. The computer will then look at the coarse sensors C-1 and C-2 of the front, rear and end level sensors and all of the coarse tilt sensors will be activated as indicated by process block 66. Subsequently all of the valves 30, 32, 34 and 36 which raise the machine will be activated as represented by process block 67. The computer will next determine if an automatic level mode is selected as represented by decision block 68. If not, all valves are deactivated as indicated at process block 69.

If an automatic mode is selected, the computer will determine if any coarse sensor detects a tilting of the main frame 16 by more than 2°. This is shown at decision block 70. If not, raising is continued. If yes, all valves are deactivated as well as the tilt sensors. This is indicated at process block 71. In the latter event, the releveling mode in the flow chart designated by the letter C is then repeated.

Figure 8:
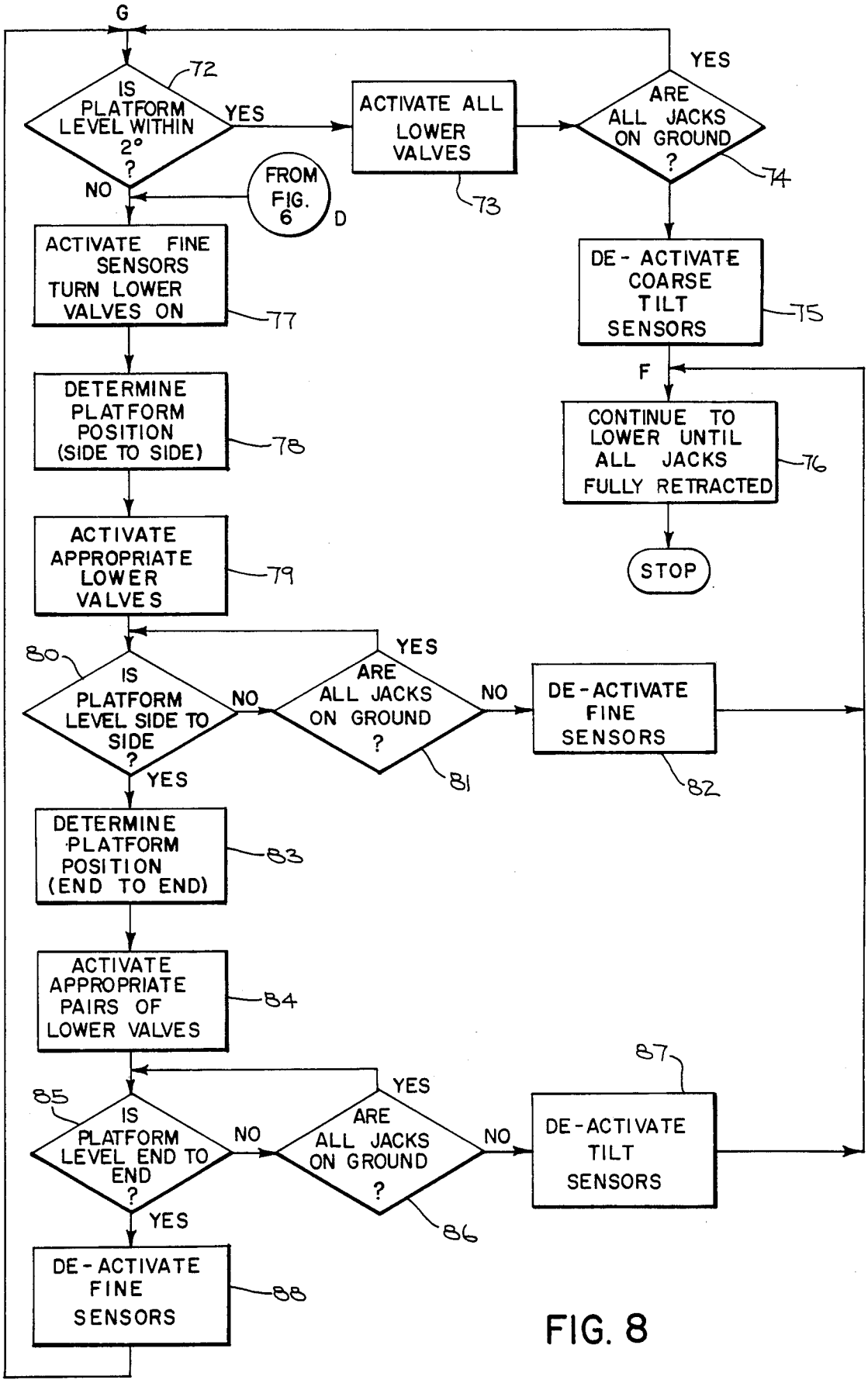
Figure 9A:
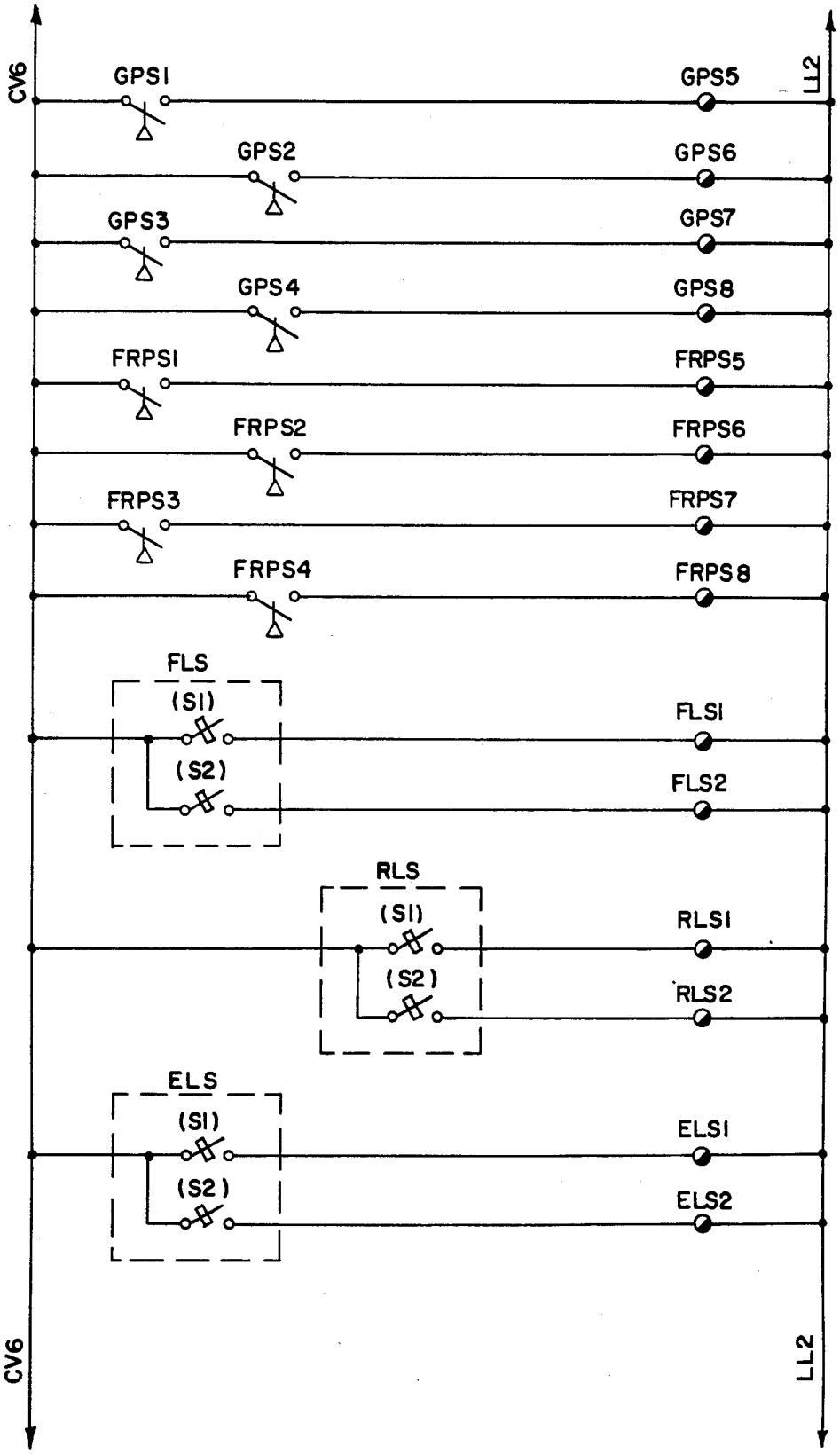
Figure 9B:
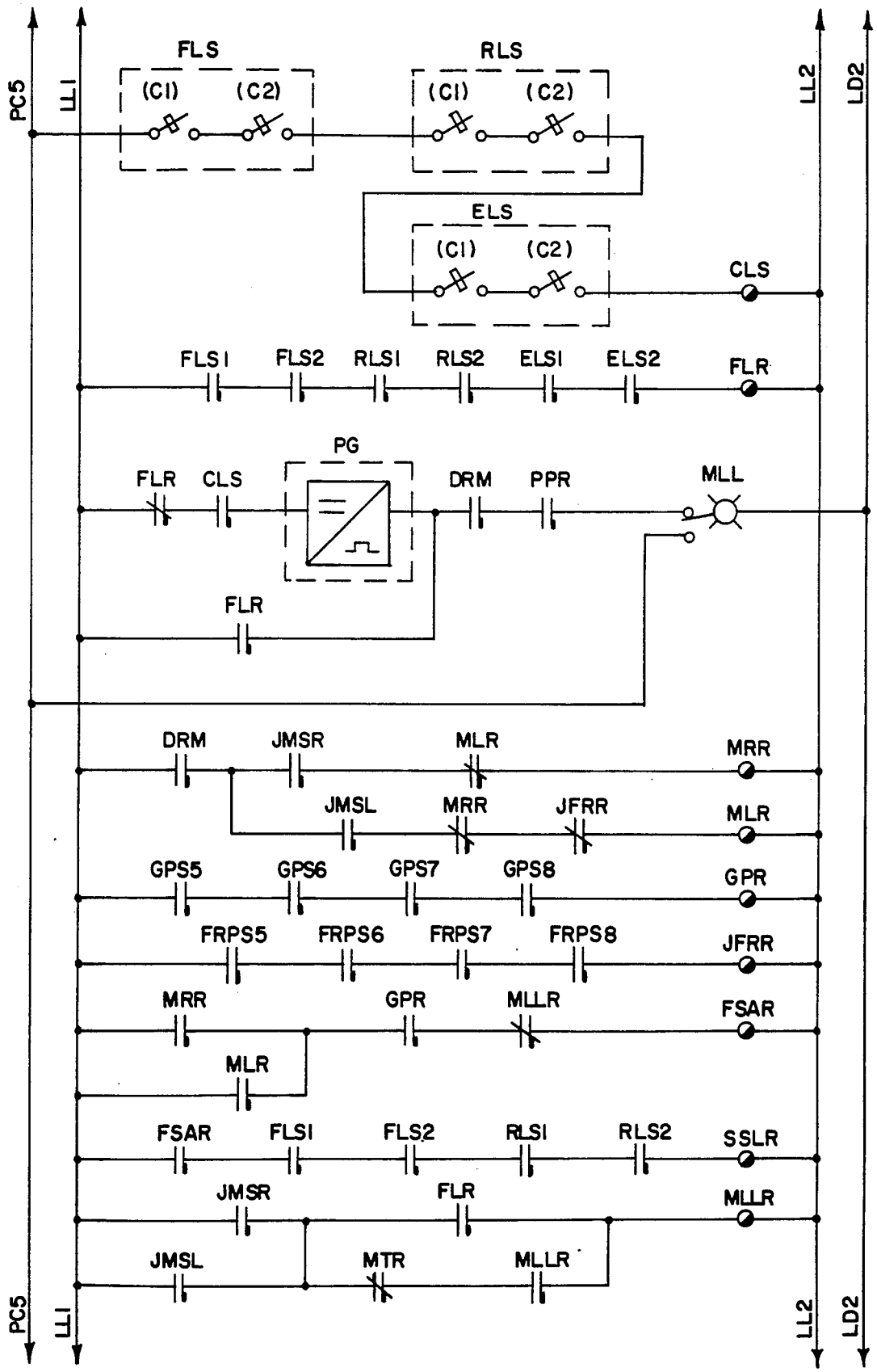
Figure 9C:
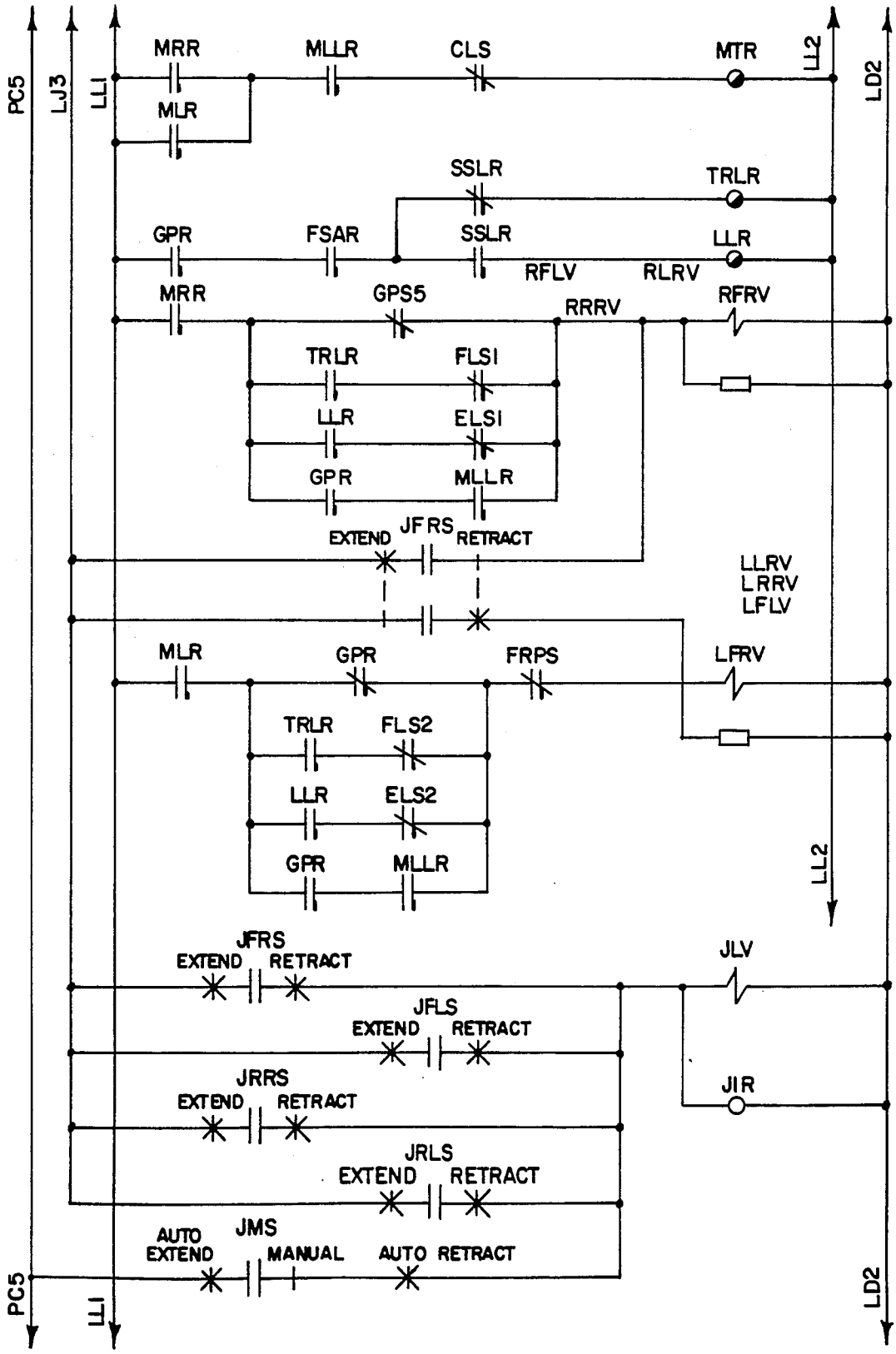

The G indication in the flow chart in FIG. 8 indicates the conditions of the machine platform 16 during lowering. A decision is made if it is out of level by 2° or more (see decision block 72) during lowering and how a releveling takes place as shown by the D indication. On the other hand if the platform 16 is within 2° then all of the lowering valves 31, 33, 35 and 37 are activated (see process block 73) on the condition that all of the jacks 12–15 are on the ground as indicated by decision block 74. In the event that they are not, then the coarse tilt sensors C-1 and C-2 are deactivated (see process block 75) and the machine lowering process is continued until all the jacks are fully retracted as illustrated at process block 76 and a stop condition effected. The D designation in the flow charts indicates the releveling of the machine during lowering mode of the main frame 16. The fine sensors S-1 and S-2 are activated and the lowering valves 31, 33, 35 and 37 are turned on, as indicated at process block 77. The determination is then made if the frame 16 is level side-to-side as seen at decision block 78. If not, the appropriate lowering valves are activated as represented by process block 79. A determination is then made if the platform is level side-to-side, as seen at decision block 80. If not, a determination is made if all the jacks are on the ground as represented by decision block 81. If not, the fine sensors S-1 and S-2 are deactivated (see process block 82) and the jacks are continued to be lowered as illustrated by the F indication and process block 76. If the jacks are on the ground, the platform releveling from side-to-side is repeated. It should be stated that if at any time during the lowering procedure a jack is lifted off the ground, the machine will be lowered without any leveling action attempted. If on the other hand the platform is level side-to-side, then a determination is made if the platform is level end-to-end through the end level sensors, as illustrated at decision block 83. If so, the appropriate pairs of lowering valves 31, 33, 35 and 37 are activated indicated at process block 84. A determination is again made if the platform is level from end-to-end, as indicated at decision block 85. If not, a determination is made if all the jacks are on the ground, as illustrated at decision block 86. If not, all tilt sensors will be deactivated, as seen at process block 87 and process mode F is pursued until all jacks are fully retracted. If main frame 16 is level end-to-end, the fine sensors will be deactivated as indicated at process block 88 and that portion of the flow chart designated with the G will be pursued with continued lowering.

As indicated above, the lowering process is continued until one or more jacks leave the ground. At that stage, the leveling process will be discontinued as it is no longer feasible to conduct the leveling action if one of the jacks no longer is in contact with the ground surface. This condition would take place when: the crawler 11 contacts the ground and one or more jacks lift off the ground; or if the machine is level and one or more jacks is extended a greater distance and would be the first jack which moves off the ground surface during a lowering process.

Throughout the foregoing description of the flow diagram it will be appreciated that once the platform is within the ±0.5° fine sensor range the fine sensors are turned off. They are not again activated until the machine is out of level by more than 2° which is sensed by the coarse sensors.

As indicated earlier and to better understand the foregoing procedure in the flow diagram, there is included herewith an Appendix A depicting a ladder type schematic view of the programmable computer as it operates in conjunction with the various sensors to raise and lower the jacks in the automatic raising and lowering operation. The symbol descriptions utilized therein is indicated therewith. It will be appreciated that some of the symbols are not specifically referred to in the previously described procedure but will be commonly employed in conjunction with a blast hole drill operation.

In the foregoing description, mercury switches are indicated as the preferred type of sensors for the fine level sensor and the coarse level sensors. Any other type of level sensors switching devices could be substituted, for example, a pendulum type switch could be employed and still accomplish the advantages of the present system. Neither is it necessary that any one particular computer program be employed. Any programmable computer which can carry out the functions of receiving signals from tilt sensors to activate valving devices could be employed. The three way valves which control the raising and lowering of these jacks which are of a solenoid type are also exemplary. Any other type of electrically operated valve which can provide a flow of fluid to and from a hydraulic jack could be utilized.

It will thus be seen that through the present invention there is now provided an automatic leveling system for a drilling apparatus which can be completely automated and still control the raising or lowering of the machine without unnecessary concern of undue stress and strain in the frame structure. The leveling system is self-compensating in that if any of the jacks leave the ground at different times the unit will automatically be deactivated. While the automatic leveling system has been shown for use in particular with blast hole drill machinery, it is apparent that it would work as well with any type of leveling operation where precise leveling must be accomplished in conjunction with large industrial machinery.

We claim:

1. A leveling system for a blast hole drill or the like having a base plane comprising:

jack means spaced from one another defining first and second axes in the base plane which are generally transverse to each other;

fluid supply means operatively connected to said jack means;

valve means connected to said fluid supply means and said jack means;

sensor means adapted to continuously detect the attitude of the base plane along the first and second axes;

said sensor means including a first sensor device to detect an attitude within a fine level range and a second sensor device to detect an attitude outside a coarse level range; and control means operatively connected to said sensor means and said valve means to provide a raising or lowering mode of operation of said jack means in conjunction with said first sensor device and a constant releveling mode of operation in conjunction with said second sensor device wherein said constant releveling is defined by an interruption of said raising or lowering mode.

2. The leveling system of claim 1 wherein said base plane is defined by a deck having corners and said jack means are defined by two pairs of hydraulic jacks positioned adjacent the corners of said base deck.

3. The leveling system of claim 1 wherein each said jack means includes a ground pressure sense switch and a full retract pressure sense switch.

4. The leveling system of claim 1 wherein said sensor means are constructed and arranged to detect the attitude of said base plane along a first and second axes and at three different locations.

5. The leveling system of claim 4 wherein two of said three different locations are at the front and back of the base plane.

6. The leveling system of claim 1 wherein said first sensor device is adapted to detect a level condition within about 0.5 degrees and said second sensor device is adapted to detect an out of level condition of about 2 degrees.

7. The leveling system of claim 1 wherein said control means includes a programmable logic control.

8. The leveling system of claim 7 wherein said programmable logic control and control means are constructed and arranged to selectively activate said jack means when one of said sensor devices is activated.

9. The leveling system of claim 8 wherein one of said sensor devices is activated at an out of level condition of about 2 degrees for said base plane.

10. A leveling system for a blast hole drill or the like having a base deck comprising:

jack means spaced from one another defining first and second axes in the base plane which are generally transverse to each other;

fluid supply means operatively connected to said jack means;

valve means connected to said fluid supply means and said jack means;

sensor means adapted to continuously detect the attitude of the base plane along the first and second axes;

said sensor means including a first sensor device to detect an attitude within a fine level range and a second sensor device to detect an attitude outside a coarse level range; and control means operatively connected to said sensor and said valve to provide a raising or a lowering of said base deck by means of said jack means when said first sensor device detects an attitude within a fine level range degree and a releveling of said base deck by means of said jack means when said second sensor device detects an attitude outside said coarse level range.

11. The leveling system of claim 10 wherein said control means in conjunction with said valve means and said jack effects a stopping of said raising or lowering of said deck in conjunction with said second sensor device.

12. The leveling system of claim 11 wherein said control means is constructed and arranged to effect a deactivation of said first sensor device when said raising or lowering of said base deck is taking place.

13. The leveling system of claim 11 wherein said attitude of said fine level range is a leveling condition of said deck within ±0.5 degrees and said attitude of said coarse level range is an out of level condition of said deck of about 2 degrees or more.

* * * * *